US005477969A

United States Patent [19]

Beeskau et al.

[11] Patent Number: 5,477,969

[45] Date of Patent: Dec. 26, 1995

[54] WALL PANEL DISPLAY SYSTEM

[75] Inventors: Colin Beeskau, Pitt Meadows; Colin Adamson, North Vancouver; Doug Allport, Burnaby, all of Canada

[73] Assignee: CSL Plastics Inc., Langley, Canada

[21] Appl. No.: 210,593

[22] Filed: Mar. 17, 1994

[51] Int. Cl.[6] ..... A47F 5/00

[52] U.S. Cl. ..... 211/87; 211/94; 211/90; 248/225.11

[58] Field of Search ..... 211/87, 88, 90, 211/94, 103, 59.1; 248/220.2, 220.3, 224.3, 225.1

[56] References Cited

U.S. PATENT DOCUMENTS

| | | | |
|---|---|---|---|
| 3,322,287 | 5/1967 | Ragir | 211/87 |
| 4,598,504 | 7/1986 | Itagaki | 211/87 X |
| 4,735,324 | 4/1988 | Wilcek | 211/94 X |
| 4,752,010 | 6/1988 | Holztrager . | |
| 4,891,897 | 1/1990 | Gieske et al. . | |
| 4,932,538 | 6/1990 | Gambello . | |
| 5,337,903 | 8/1994 | Wolcovitch et al. | 211/87 X |

OTHER PUBLICATIONS

Crystplex Plastics Ltd., Slat Wall, Brochure, 1989.

*Primary Examiner*—Robert W. Gibson, Jr.
*Attorney, Agent, or Firm*—Oyen Wiggs Green & Mutala

[57] ABSTRACT

A display wall system is disclosed. The system is suitable for use in displaying items and can be quickly reconfigured. The system includes modules which can be affixed to a wall to form wall panels, and accessories such as shelves, hooks, dividers, and hangers which may be mounted to the wall panels. The wall panels have a generally flat front face and a grid of intersecting grooves in the front face. The grooves have generally parallel walls extending generally perpendicular to the front face of the panel. Accessories for mounting to the panel have a mounting end bearing one or more planar members which can be pushed into the grooves where they are held by friction. The planar members are somewhat thicker than the grooves are wide so that the planar members fit in the grooves with a tight interference fit. The components of the system are light in weight, durable, simple to install and can be installed with minimal waste. The resulting wall panel display system is attractive to the eye and does not have any visible seams.

26 Claims, 10 Drawing Sheets

WALL PANEL DISPLAY SYSTEM

FIELD OF THE INVENTION

This invention relates to a wall panel adapted to receive and retain accessories for displaying objects, such as merchandise in a retail store, and to a system for displaying objects comprising a wall panel and accessories adapted for mounting to the wall panel.

BACKGROUND OF THE INVENTION

Many businesses require a flexible system for displaying wares. Such systems typically comprise a flat wall-mounted panel and various accessories which may be detachably affixed to the panel. The accessories may include, for example, shelves, hooks, signs, price tags, dividers rand hangers. Such systems are flexible and allow the business to change the display rapidly by moving and changing the accessories on the wall panel.

In many retail establishments a large proportion of the available wall space is covered with panels for such displays. It is important, therefore, that such display panels be aesthetically pleasing.

One system that is in wide-spread use is slot wall. Accessories for a slot wall system have a mounting end comprising an upwardly projecting flange. Slot wall panels have horizontal slots for receiving the flanges of accessories. The upper lip of the mouth of each slot is undercut. When accessories are mounted to the slot wall panel the flanges sit in the undercut behind the upper lip of the mouth of a slot.

Some disadvantages of the slot wall system are: slot wall panels tend to be heavy; the steps required to produce a slot with an overhanging lip make slot wall panels relatively expensive to manufacture; and, slot wall panels are expensive to install because they generally can be cut only with a saw and, it is difficult to use left over sections of slot-wall panel without leaving unsightly seams.

Geiske et al. U.S. Pat. No. 4,891,897 discloses a slot wall panel having slots adapted to receive flat shelves in addition to standard slot wall accessories. Shelves are retained in the slots in the Geiske et al. panel by a hook and loop fastener. The inner ends of the slots are covered with a hook and loop material such as VELCRO™. A matching strip of hook and loop fastener is affixed to the inner edges of each shelf. When the shelf is placed in the slot the hook and loop fastener on the shelf edge adheres to the hook and loop material in the slot to hold the shelf in place.

Holztrager, U.S. Pat. No. 4,752,010 describes another variation of a slot wall panel which has slots adapted for receiving shelving as well as slot wall accessories. In the Holztrager system there is a lip at the lower edge of the mouth of each slot. A shelf is installed in the slot by inserting it in the slot and cantilevering it over the lip. The rear upper edge of the shelf bears against a bearing surface on the top side of the rear of the slot. The shelf is then held in place by friction between the top rear edge of the shelf and the bearing surface. A ridge may be provided on the lower surface of the shelf. The ridge prevents the shelf from being pulled straight out of the slot.

Gambello, U.S. Pat. No. 4,932,538 discloses a modular wall panel which is compatible with slot wall accessories. Each module comprises a grid-like array of flat sub panels spaced outwardly from a mounting member. A complete slot wall panel can be assembled by affixing a number of modules to a wall. The resulting panel has a grid of intersecting vertical and horizontal channels. The vertical channels play no role in affixing accessories to the panel. The horizontal channels provide generally the functions of slots in a standard slot wall panel.

SUMMARY OF THE INVENTION

This invention provides a wall panel for receiving detachable accessories. The wall panel comprises: a generally planar front face; a first groove in the front face; and a second groove in the front face intersecting the first groove at an angle. The first and second grooves each have first and second walls extending generally perpendicular to the front face. The first walls of the first and second grooves being resiliently displaceable away from the second walls of said first and second grooves respectively.

In a preferred embodiment, the wail panel has a plurality of spaced apart grooves parallel to the first groove and a plurality of spaced apart grooves parallel to the second groove.

A second aspect of the invention provides a system for detachably affixing an accessory to a wall. The system comprises: a first planar member having a thickness and affixed to the accessory; a second planar member affixed to the accessory at an angle relative to the first planar member; a wall panel module having a front face; means for affixing the wall panel module to the wall; a first groove in the front face of the wall panel module for receiving the first planar member, the first groove having first and second walls spaced apart by a distance slightly less than the thickness of the first planar member; a second groove in the front face for receiving the second planar member, the second groove intersecting the first groove at generally the same angle as the angle between the first and second planar members and having first and second walls. The first wall of the first groove is resiliently displaceable away from the second wall of the first groove by insertion of the first planar member in the first groove.

A third aspect of the invention provides a system for detachably affixing an accessory to a wall. The system comprises: a mounting means on the accessory. The mounting means is X-shaped in section and comprises: a first planar member, having a first width and a first thickness, affixed to the accessory; and a second planar member having a width generally equal to the first width and a thickness generally equal to the first thickness affixed to the accessory perpendicular to and intersecting the first planar member. The second planar member projects generally equally on opposite sides of the first planar member. The system further includes: a wall panel module comprising a unitary sheet of material, the module having a front face; means for affixing the wall panel module to the wall; a first plurality of equally spaced apart indentations in the sheet, the first indentations comprising first grooves in the front face for receiving the first planar member, the first grooves each comprising first and second side walls spaced apart by a distance slightly less than said thickness of said first planar member and a rear wall; and, a second plurality of equally spaced apart indentations in the sheet, the second indentations comprising second grooves in the front face for receiving the second planar member, the second grooves perpendicularly intersecting the first grooves to provide a matrix of square sections separated by grooves, the second grooves each comprising first and second walls spaced apart by a distance slightly less than said thickness of the second planar member and a rear wall. The front faces of the rear walls of the first and second grooves comprise longitudinal V-shaped notches. The notches comprise generally planar sections of said rear walls intersecting at a dihedral angle. The first walls of the first and second grooves are resiliently displaceable away from the second walls of the first and second grooves respectively by insertion of the first and second planar members in the first and second grooves respectively to securely hold the first and second planar members in the first and second grooves respectively by frictional forces between faces of the first and second planar members and the walls of the grooves.

BRIEF DESCRIPTION OF THE DRAWINGS

In drawings which illustrate specific embodiments of the invention, but which should not be construed as restricting the spirit or scope of the invention in any way.

DETAILED DESCRIPTION OF THE INVENTION

Figure 1:
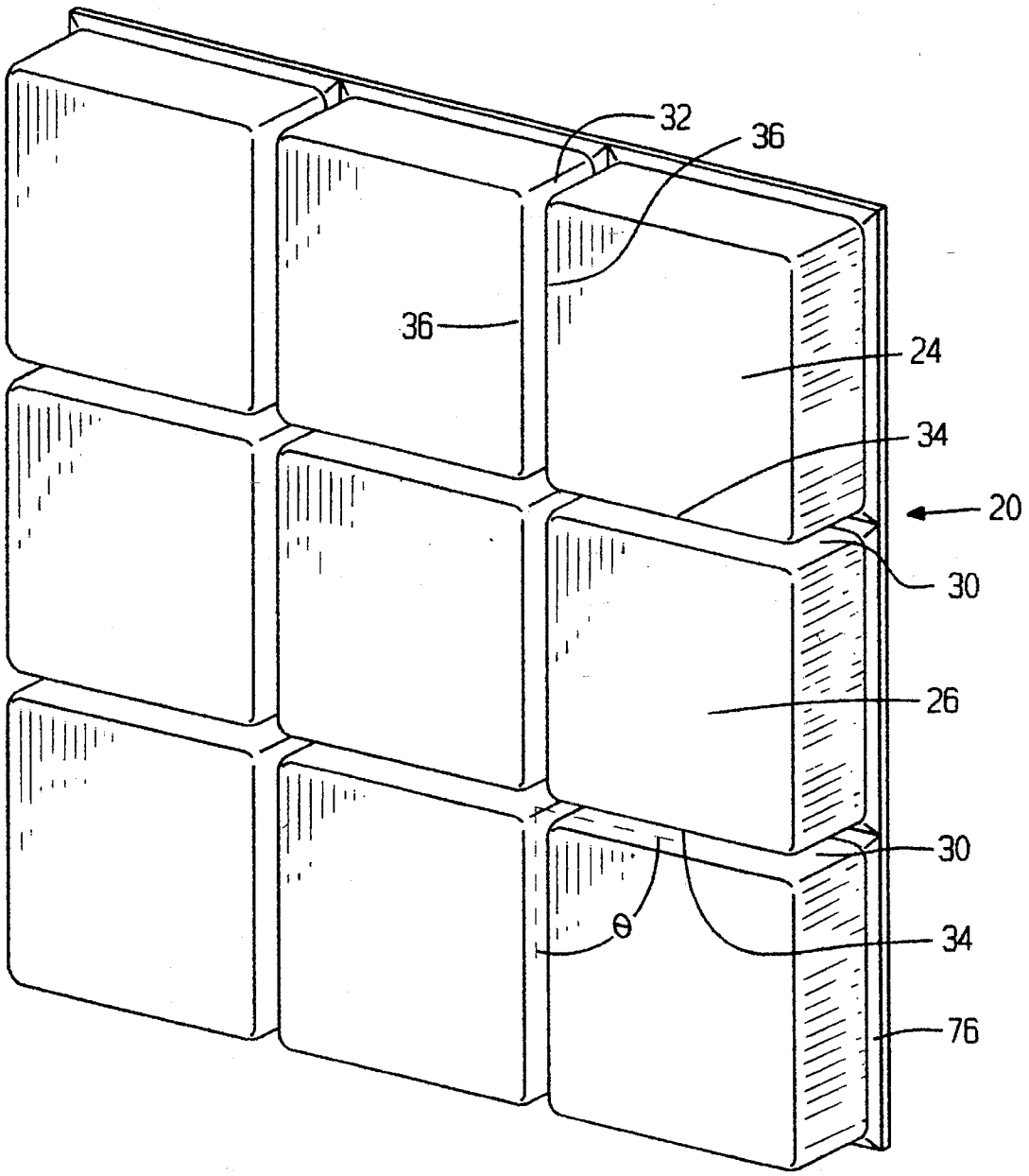
FIG. 1 is a perspective view of a wall panel module according to the invention.

The invention provides a wall panel which may be assembled by mounting one or more modules to a wall. FIG. 1 shows a wall panel module 20 according to the invention. Module 20 comprises a generally planar front surface 24. Front surface 24 is divided into a regular array of rectangular segments 26 by intersecting grooves 30, 32. Preferably the spacing between grooves 32 is the same as the spacing between grooves 30 and segments 26 are generally square.

Grooves 30 intersect grooves 32 at an angle θ. In FIG. 1, grooves 32 are perpendicular to grooves 32 and θ is a right angle. The corners 34, 36, between segments 26 and grooves 30, 32 are preferably rounded for ease of insertion of accessories 40 and because rounded corners have a pleasing appearance.

Grooves 30, 32 are preferably uniformly spaced and penetrate substantially entirely through module 20. Preferably grooves 30, 32 all have the same depth. For retail display applications, grooves 30, 32 are typically between approximately 5 cm and 8 cm apart and between approximately 2 cm to 6 cm deep and are preferably between 2.5 cm and 4 cm deep. In general, increasing the dimensions of module 20 by increasing the spacing between grooves 30, and 32, increasing the depth of grooves 30 and 32 and increasing the thickness of the material from which module 20 is made tends to increase the load which can be supported by an accessory attached to panel 20. Panels 20 may be made in any convenient size. For example, approximately 60 cm by 120 cm is a convenient size for transporting and installing panels 20.

Panels 20 may be conveniently manufactured by vacuum-forming a suitable plastic, such as the 0.45 cm thick general purpose ABS plastic sheet which is available from BASF Corporation, Plastic Materials Div., of Parsippany, N.J. or Monsanto Company, Of St. Louis, Mo., into a female mould.

Figure 2:
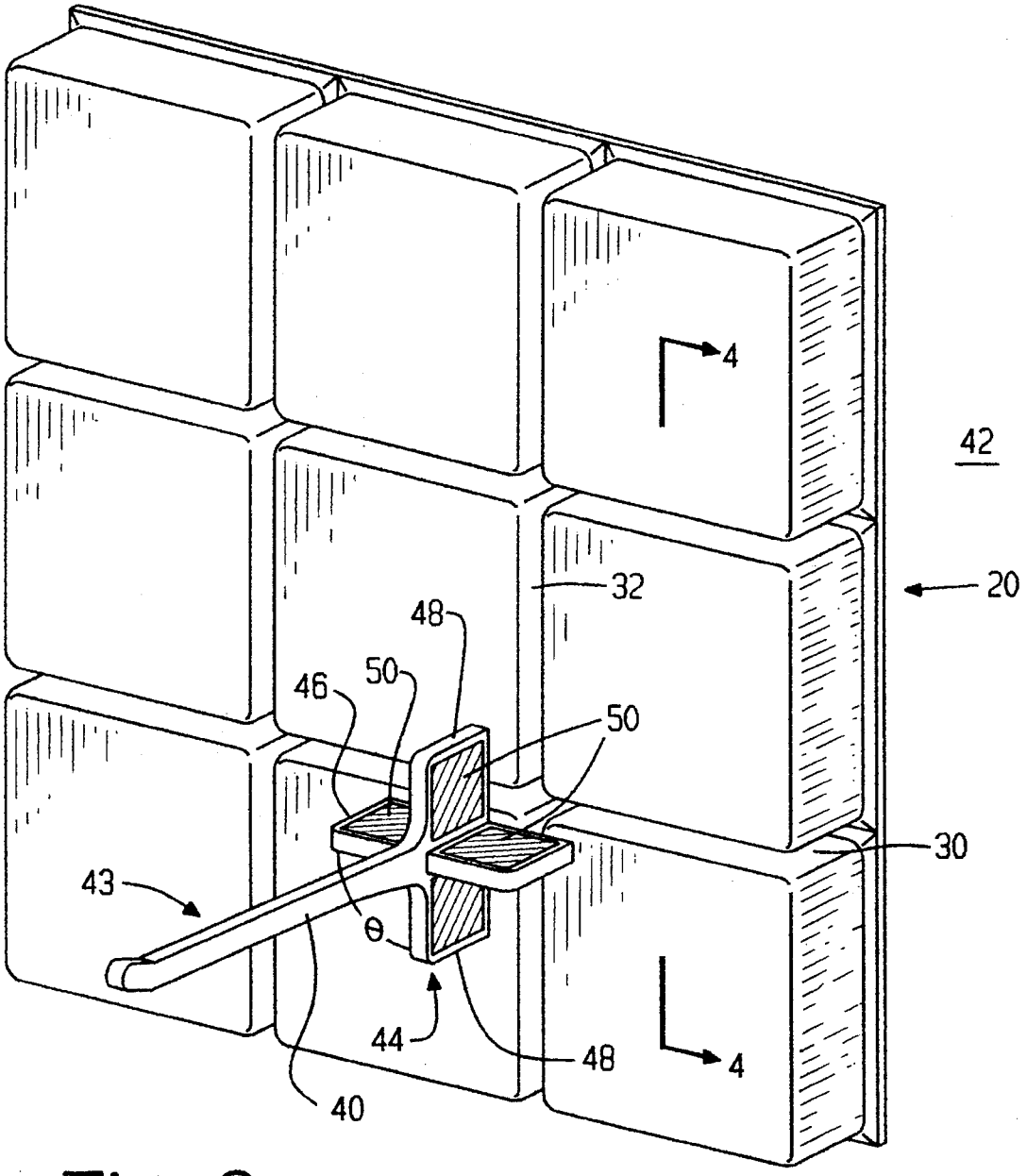
FIG. 2 is a perspective view of the wall panel module of FIG. 1 mounted to a wall with an accessory about to be mounted to the wall panel module.

FIG. 2, shows an accessory 40 about to be inserted into a module 20 which has been affixed to a wall 42. Accessory 40 comprises a hook 43 and a mounting end 44. Mounting end 44 comprises a first planar member 46 and a second planar member 48 which is mounted at an angle θ to planar member 46. In module 20 θ is 90 degrees so planar members 46 and 48 intersect each other at a fight angle.

Figure 4:
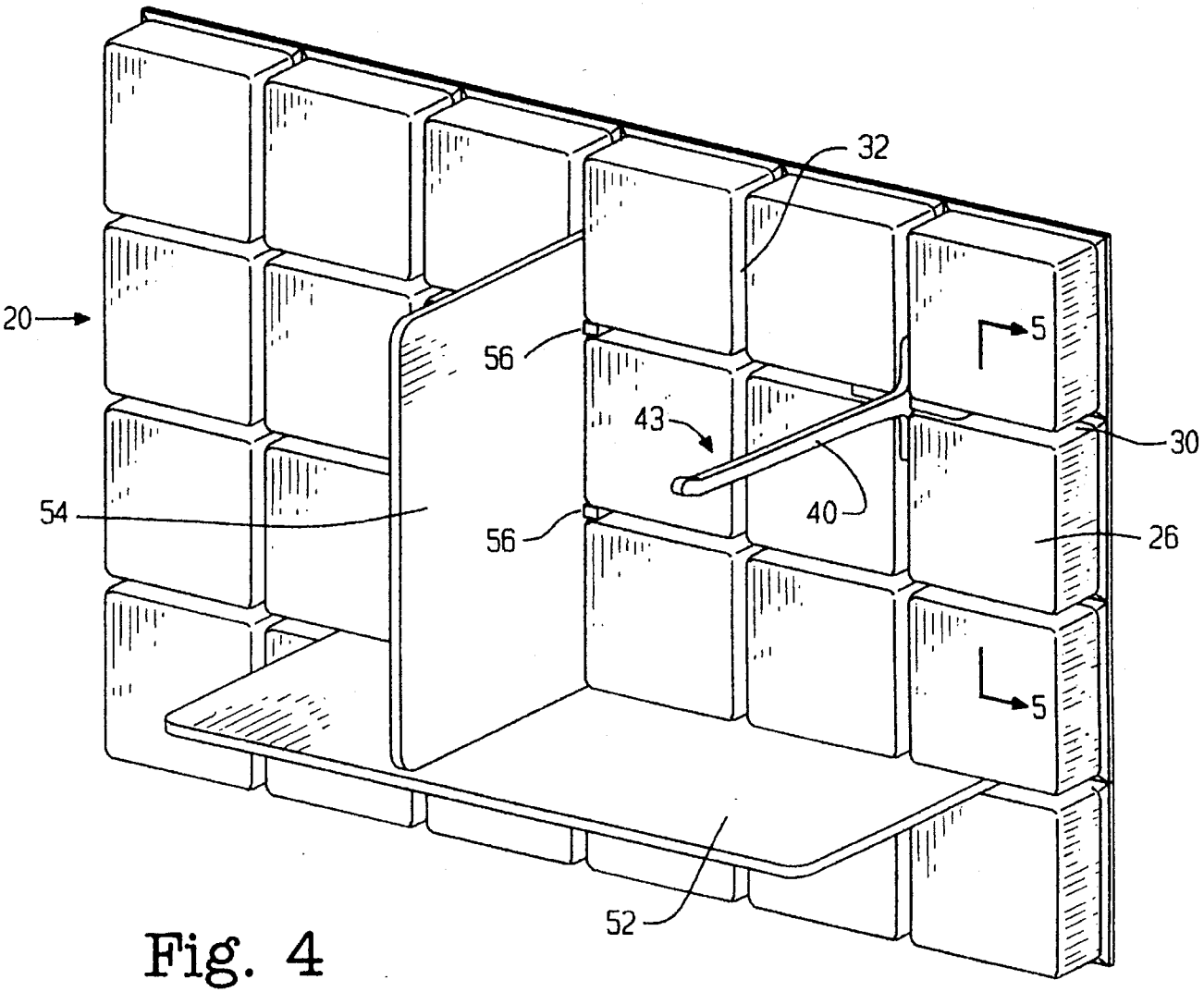
FIG. 4 is a perspective view of the wall panel module of FIG. 2 with several accessories mounted to it.

As shown in FIGS. 2 and 4, accessory 40 is mounted to module 20 by aligning planar member 46 with a groove 30, aligning planar member 48 with a groove 32 and pushing planar members 46 and 48 until they are frilly inserted in grooves 30 and 32 respectively. After accessory 40 has been mounted (FIG. 4), hook 43 is left projecting from module 20.

As is described more fully below with respect to FIGS. 5 and 6, planar members 46 and 48 are held in place in grooves 30 and 32 by friction between the faces of planar members 46 and 48 and the walls of grooves 30 and 32. Layers 50 of friction material, such as friction tape, may be applied to the faces of planar members 46, 48 to increase the frictional force resisting the withdrawal of accessory 40 from module 20. 3M™ part number 8562 clear urethane abrasion resistant tape is a suitable material for layers 50. Preferably layers 50 cover as much of the surfaces of planar members 46, 48 that contact the walls of grooves 30, 32 as possible.

Figure 3:
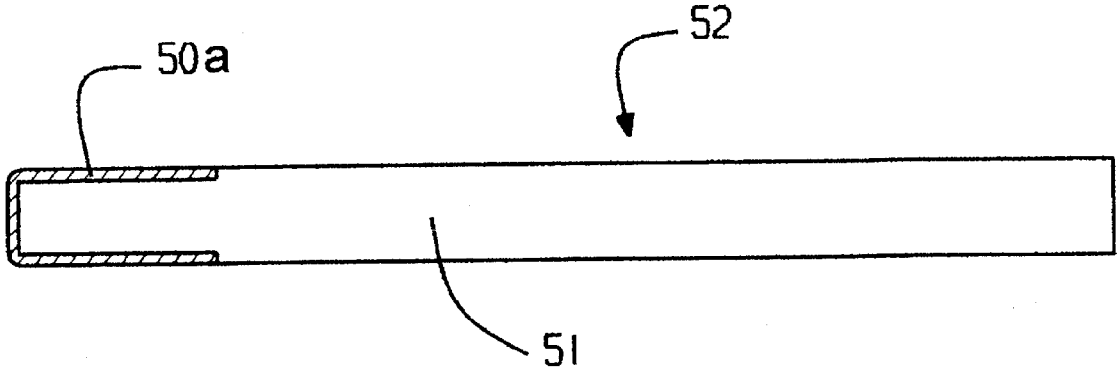
FIG. 3 is a section through a shelf according to an alternative embodiment of the invention.

As an alternative to using friction tape for layers 50, layers 50 may be integral with accessories 40. For example, FIG. 3 shows a shelf, 52, having a body 51 extruded from rigid PVC plastic. Layer **50*a* on shelf 52 is a thin layer of flexible PVC plastic which has been co-extruded with body 51. Layer 50*a* may be, for example, approximately 0.05 cm (0.02 inches) thick. Layer 50*a* may extend over one or more faces of the portion of shelf 52 which fits into grooves 30, 32**.

As shown in FIG. 4, a flat shelf 52 or a divider 54 may be mounted to module 20 by inserting an edge of the shelf or divider into one of grooves 30, 32. Once inserted, the shelf or divider is held in place by friction between the walls of the groove and the faces of the divider or shelf. Ribs 56 may be provided on a divider 54 or shelf 52 to further prevent the divider or shelf from sliding along the groove in which it is mounted. Vertical grooves 32 allow accessories such as divider 54 or vertical signs (not shown) to be easily and directly mounted to module 20. This is in contrast to slot wall systems in which it is difficult to mount vertical accessories.

Figure 5:
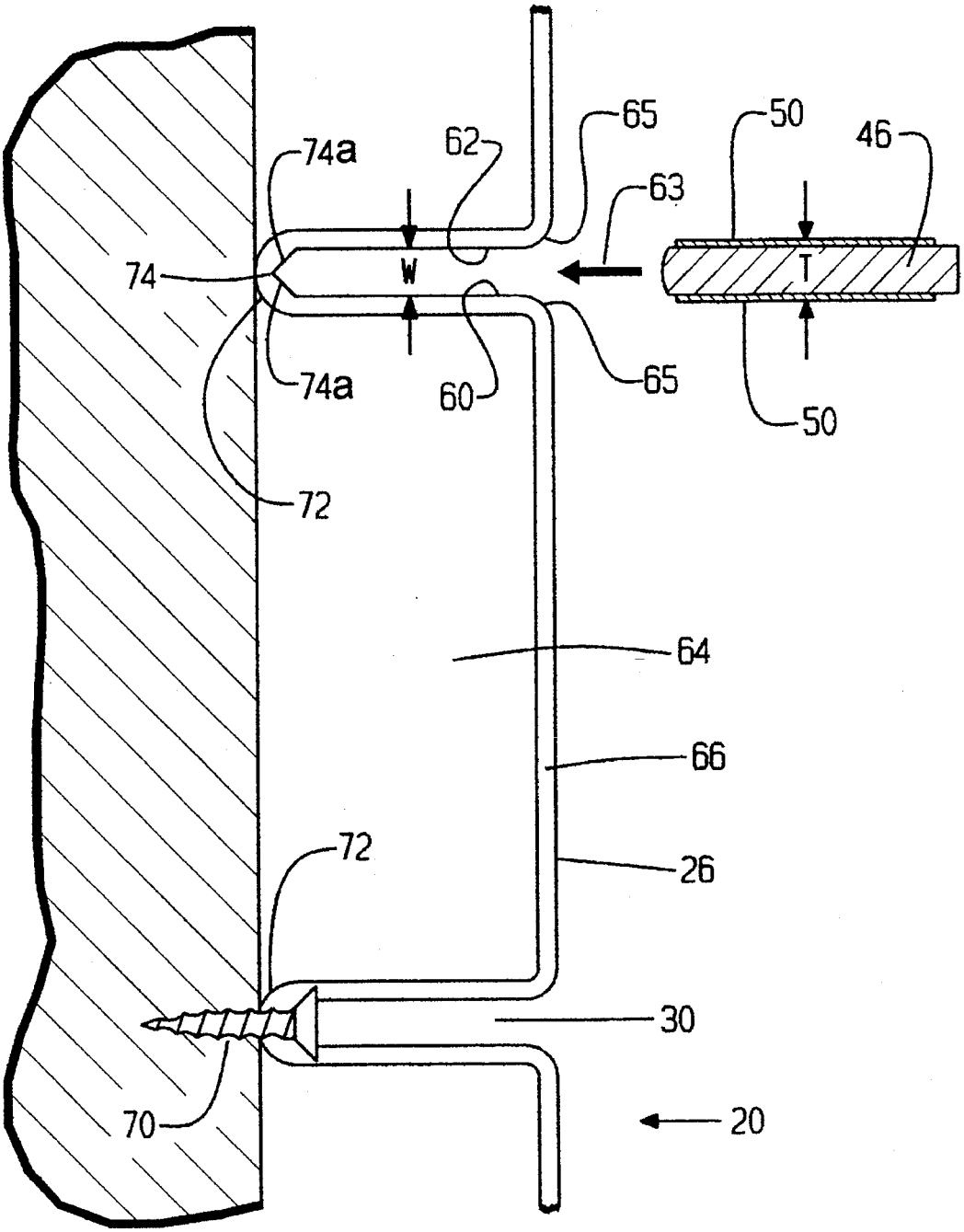
FIG. 5 is a section taken along the line 44 of the wall panel module of FIG. 2.
Figure 6:
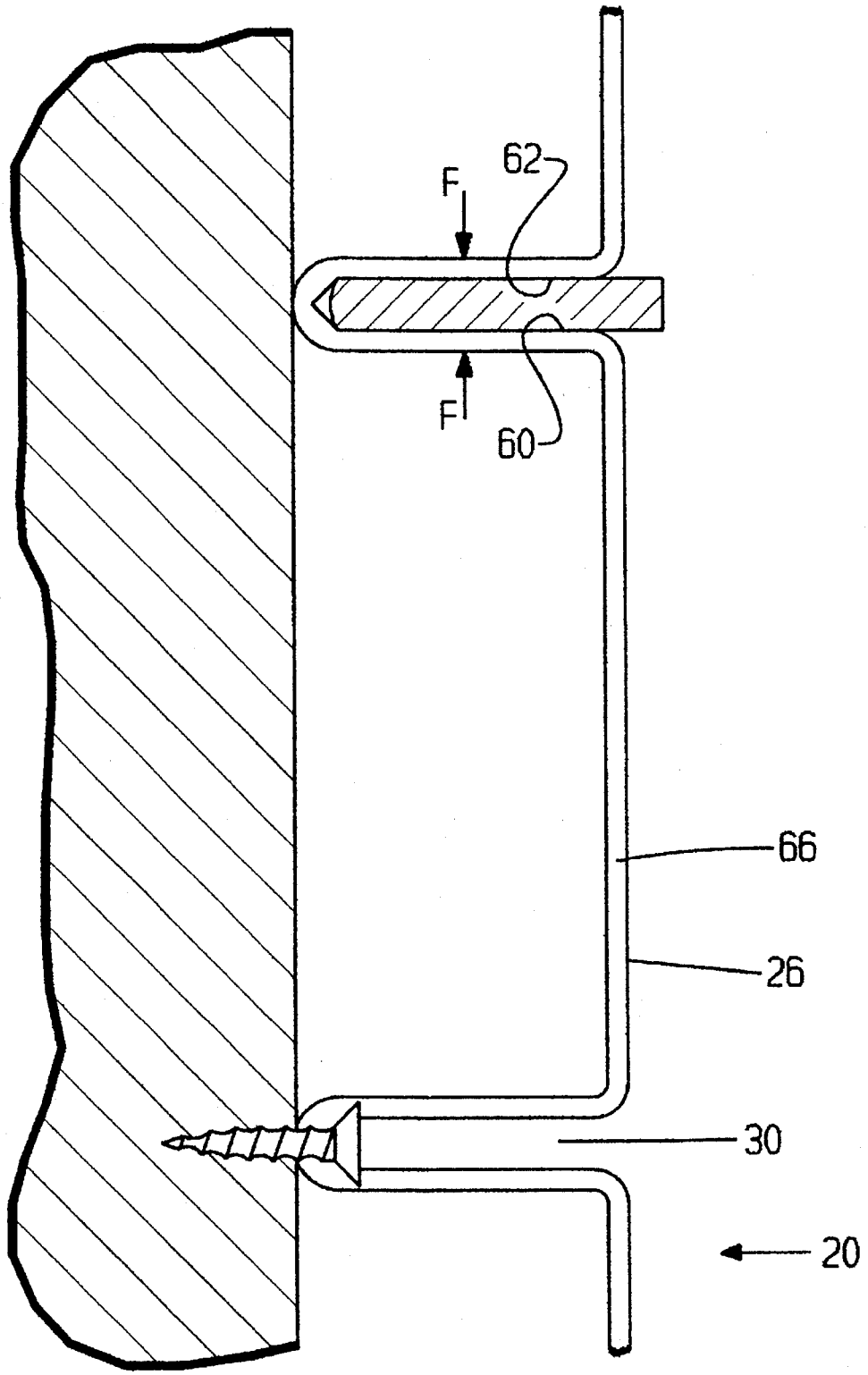
FIG. 6 is a section along the line 5—5 of the wall panel module of FIG. 3.

FIGS. 5 and 6 show the construction of grooves 30 and planar members 46 in detail. It is to be understood that grooves 32 and planar members 48 interact in an manner analogous to the interaction of grooves 30 and planar members 46. As shown in FIG. 6, planar member 46 has a tight interference fit in groove 30.

Grooves 30 have generally parallel walls 60 and 62. The width, W, of groove 30 is slightly less than the thickness, T, of planar member 46. For example, when W is 0.46 cm (0.18 inches) and modules 20 are constructed as described above, then T is preferably approximately 0.48 cm (0.188 inches).

When accessory 40 is mounted to module 20, planar member 46 is forced into groove 30 as indicated by arrow 63. During this process, walls 60 and 62 of groove 30 are forced slightly away from each other by the passage of planar member 46. Rounded corners 65 help to guide planar member 46 into slot 30.

Walls 60 and 62 are resilient. When walls 60 and 62 are moved apart by the introduction of planar member 46 they subject planar member 46 to restoring forces as indicated by arrows F in FIG. 6. These forces squeeze planar member 46 and tend to increase the frictional force between the faces of planar member 46 and walls 60, 62.

For a groove of width W the thickness T of planar member 46 is limited by the degree to which walls 60 and 62 of groove 30 may be forced apart without becoming non-parallel. If planar member 46 is too thick for a groove 30 then inserting planar member 46 in groove 30 may wedge walls 60, 62 apart at an angle. Then, only the innermost portion of planar member 46 will be in contact with walls 60, 62 and planar member 46 will not be firmly retained in slot 30. For maximum strength, when planar member 46 is fully inserted in slot 30, walls 60 and 62 should be parallel and in flat forceful contact with opposing sides of planar member 46. For a given slot 30, to obtain maximum holding force, planar member 46 is preferably as thick as possible without making walls 60 and 62 non-parallel when planar member 46 is inserted into slot 30.

If module 20 is vacuum formed, as described above, then front face 24 and the walls 60, 62 of grooves 30, 32 are formed from a single unitary sheet 66 of material. Grooves 30, 32 comprise indentations in sheet 66.

The resiliency of walls 60 and 62 depends upon resiliency of the material from which they are formed and, to some degree upon the shape of grooves 30. The corners 65 formed between walls 60 and 62 and front face 24 are rounded and preferably have a radius of curvature on the order of 0.32 cm (0.125 inches). Voids 64 may optionally be filled with a resilient foam material to enhance the resiliency of walls 60 and 62. As an alternative to vacuum forming, module 20 may be made by injection moulding a resilient plastic material or by moulding a resilient foamed plastic or rubber material.

As shown in FIG. 5, module 20 may be affixed to a wall by passing screws 70 through the rear walls 72 of grooves 30 and 32. The screws are hidden from sight and so do not detract from the appearance of module 20. Preferably the width W of grooves 30 and 32 is large enough that a mounting screw 70 may be easily installed at the junction of a groove 30 and a groove 32 and small enough that screw 70 is reasonably well hidden from view when the installation is complete. Preferably the radius of curvature of the corners formed at the intersections of grooves 30 and 32 by walls 60, 62 of grooves 30 and the walls of grooves 32 is on the order of 0.38 cm (0.15 inches). This radius and the widths of grooves 30, 32 together define the maximum size of screw head that can be inserted at the intersections of grooves 30 and 32.

V-shaped notches 74 may be provided in the centres of rear walls 72 to assist in placing screws 70 and to act as guides for cutting modules 20 to size with a knife. As shown in FIG. 5, notches 74 are preferably V-shaped notches formed by two planar surfaces **74*a* which have a dihedral angle of approximately 90 degrees. Preferably surfaces 74*a* extend the full width of the forward faces of rear walls 72. The mounting edges of planar members 46, 48 (or the mounting edges of shelves or other accessories to be inserted into grooves 30, 32**) may be bevelled for easy insertion.

Screwing module 20 to a wall increases the rigidity of module 20 and, consequently, increases the weight bearing capacity of accessories mounted to module 20. Generally, the more points of attachment there are between module 20 and a wall the more rigid is the resulting wall panel and the greater is the holding strength. The holding strength of module 20 is maximized when module 20 is affixed to a rigid wall with a suitable adhesive and/or a large number of closely spaced mounting screws 70.

Because module 20 is reinforced by the wall to which it is attached it is possible to provide a display panel according to the invention which is durable and strong when installed, and yet is considerably lighter in weight than a slot wall panel, with correspondingly lower shipping costs, and correspondingly easier handling and installation.

Figure 7:
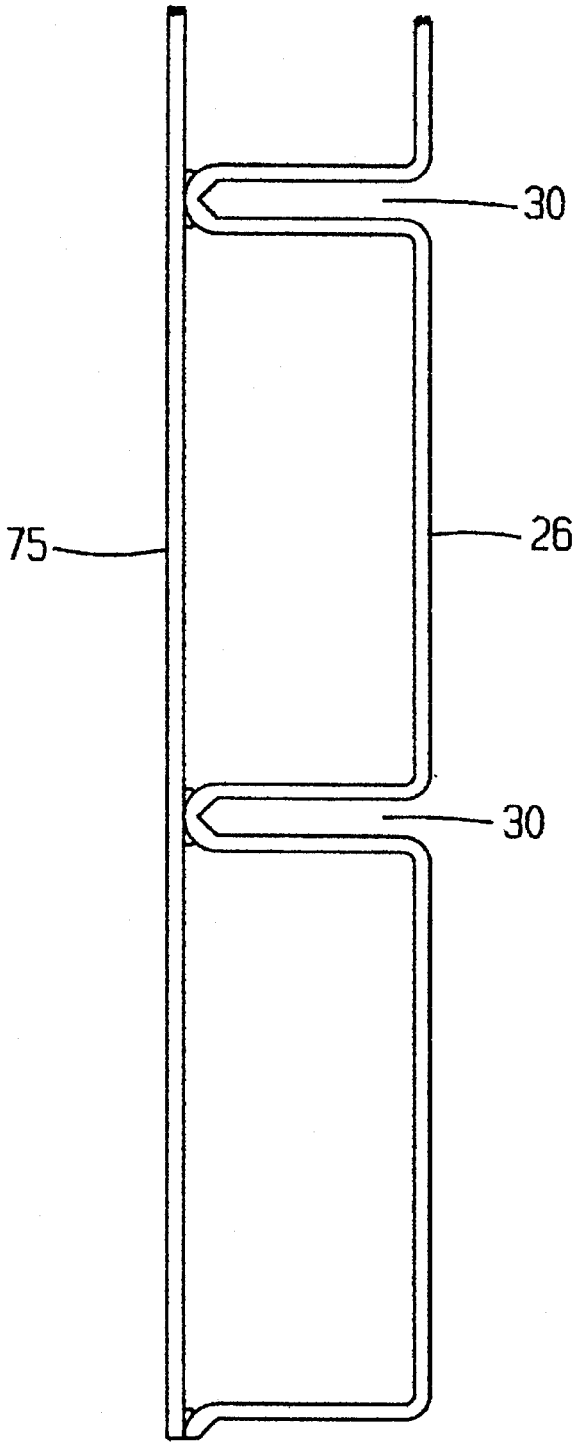
FIG. 7 is a section through a wall panel module according to the invention with a backing sheet.

As shown in FIG. 7, a backing sheet 75, such as a sheet of ABS plastic on the order of approximately 0.15 cm to 0.3 cm (0.06 inches to 0.125 inches) thick may be bonded to the rear surface of a module 20 to increase the rigidity of module 20. With a sufficiently rigid backing sheet 75, module 20 may be used in free-standing applications such as in an office divider or a free-standing display unit.

Several modules 20 may be affixed to a wall next to each other to cover a large area. As shown in FIG. 1, modules 20 have a rim 76 projecting in a flange-like fashion from their rear edges. Rim 76 is one half of the width of grooves 30 and 32, so that when two modules 20 are butted against each other a groove having the same dimensions of grooves 30, 32 is formed between the two modules 20. The seam between adjacent modules 20 is thereby hidden at the bottom of a groove and the groove formed between the adjacent modules may be used in the same manner as other ones of grooves 30, and 32. It is convenient to make rim 76 have the same profile in cross section as one half of a rear wall of grooves 30, 32.

Where the wall surface to be covered with modules 20 is an odd size, modules 20 may be trimmed to fit, simply by cutting along the centre of one of grooves 30 or 32 with a hand held knife.

Unlike slot-wall panels, modules 20 are omni-directional. The module 20, shown in FIG. 1, will function identically in any orientation turned through any multiple of 90 degrees from an initial orientation.

Because modules 20, or portions of modules 20, can be combined to cover a large area without leaving any unsightly seams the problem of wasting panel parts which are left over after an installation is virtually eliminated. Such left over parts can be easily re-used. Even a portion of a module 20 as small as two segments 26 wide by two segments high, may be installed and used.

Figure 8:
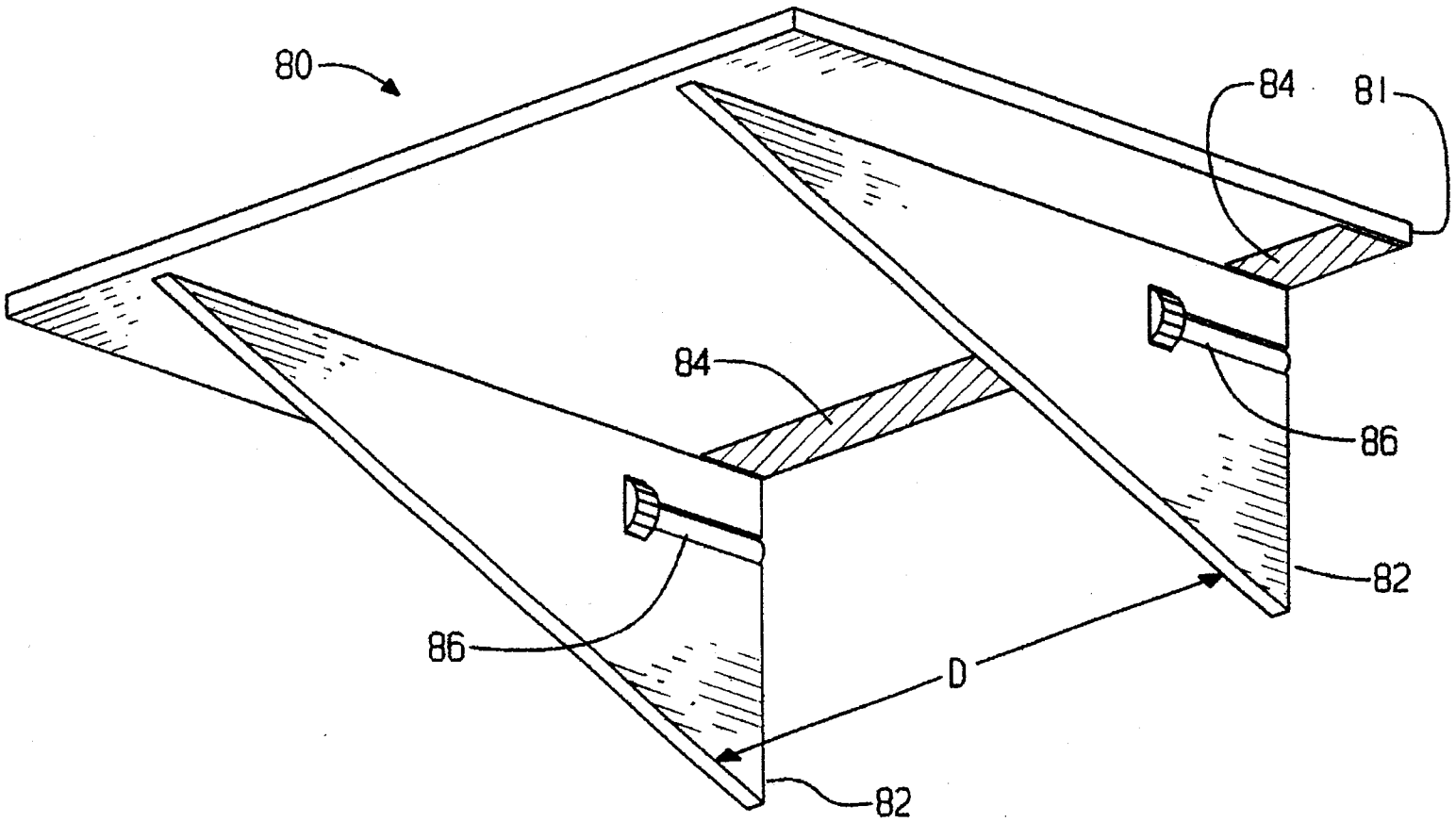
FIG. 8 is a perspective view of the underside of a shelf for mounting to the module of FIG. 1.

As shown in FIG. 4, a flat shelf 52 of suitable thickness may be simply inserted into horizontal grooves 30 in a module 20. Flat shelves 52 are suitable for bearing light weight objects. FIG. 8 shows an alternative shelf 80 which may be mounted to module 20 of FIG. 1 for bearing heavier loads. Shelf 80 is mounted to a module 20 by inserting mounting edge 81 into a horizontal groove 30. As described above with reference to planar member 46, mounting edge 81 fits into a groove 30 with an interference fit.

Shelf 80 has vertical supports 82 projecting from its underside. Vertical supports 82 are spaced apart by a distance D which is equal to a multiple of the spacing of vertical grooves 32 in module 20. Vertical supports 82 fit into vertical grooves 32 of module 20 with an interference fit. To further increase the resistance of shelf 80 to pulling out from module 20 strips 84 of friction tape may be provided on one or both sides of the mounting edge of shelf 80.

Accessories, such as shelf 80, may optionally be equipped with mechanical fasteners 86 to further enhance the resistance of such accessories to pulling out from module 20. Fasteners 86 may be, for example, rubber expansion bolts which can be tightened after the accessory has been mounted to module 20. When they are tightened, fasteners 86 expand against the sides of grooves 30 or 32 to hold the accessory in place on a module 20 with a tight friction grip.

Figure 9:
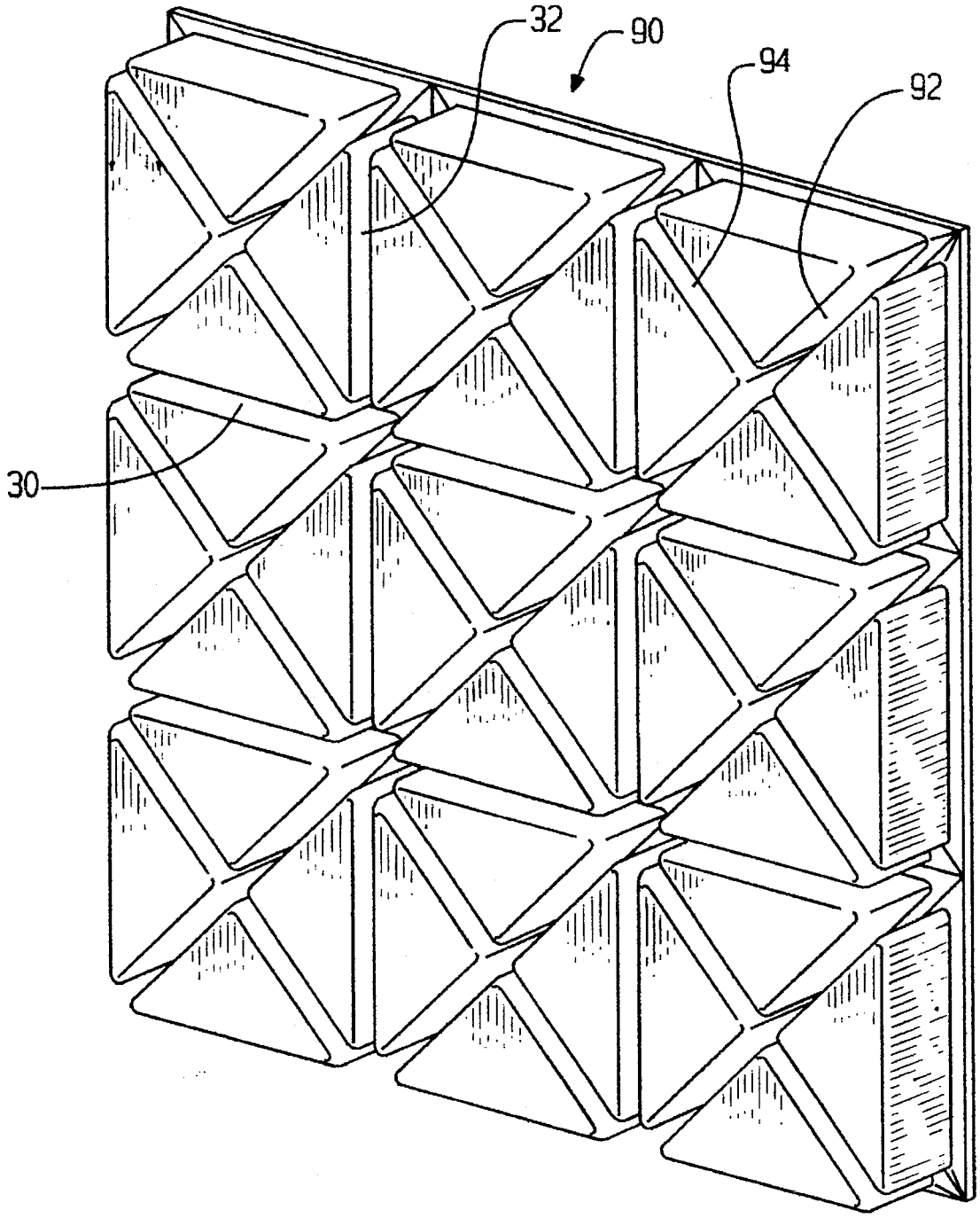
FIG. 9 is a perspective view of a wall panel module according to an alternative embodiment of the invention.

FIG. 9 shows an alternative module 90 according to the invention. In addition to vertical grooves 32 and horizontal grooves 30, module 90 has diagonal grooves 92, 94. Diagonal grooves 92, and 94 allow accessories to be mounted to module 90 at an angle and provide an alternative appearance.

Figure 10:
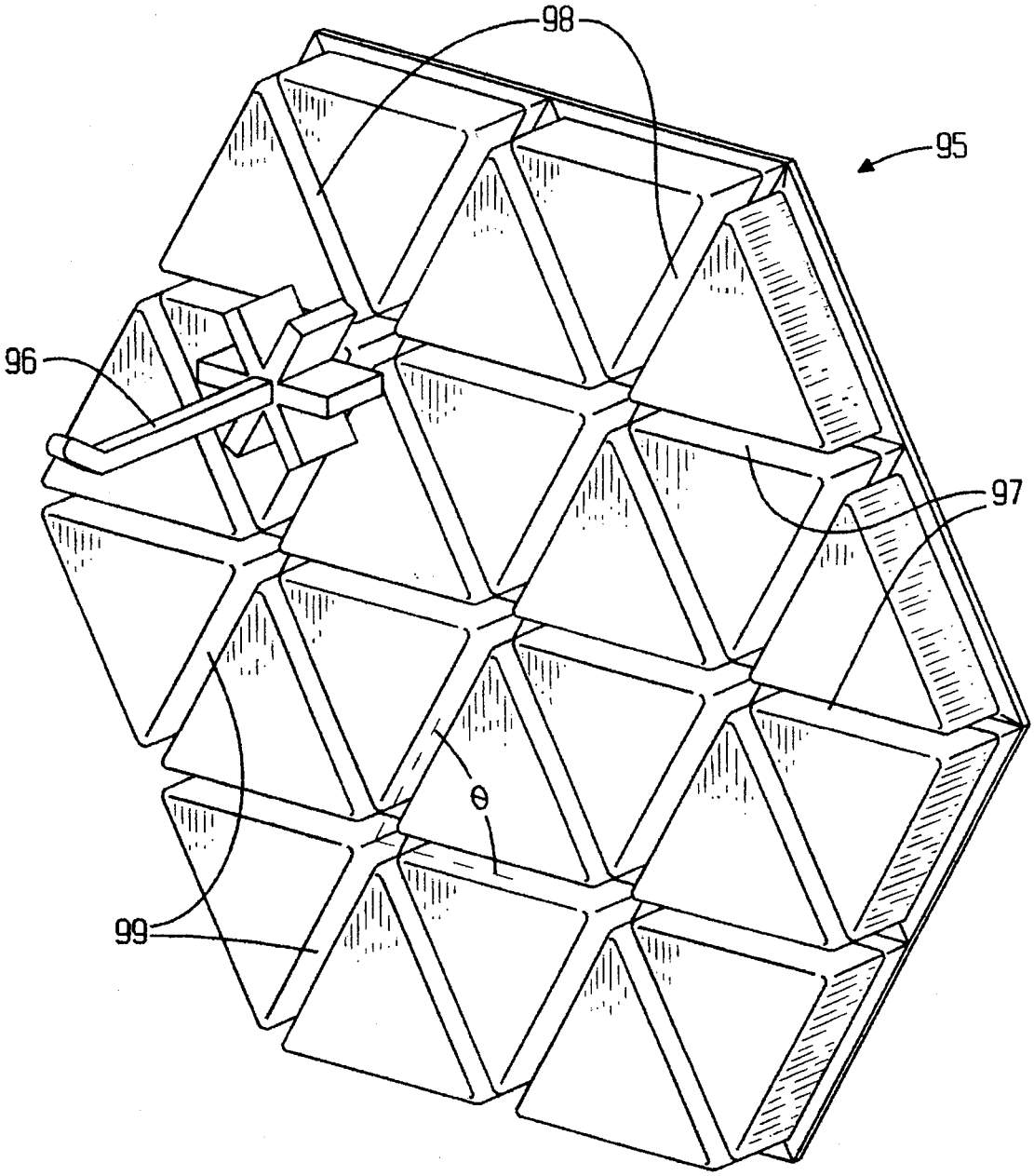
FIG. 10 is a perspective view of a wall panel module according to a second alternative embodiment of the invention.

FIG. 10 shows a further alternative module 95 and an accessory 96 for use with module 95. Module 95 has three sets of grooves 97, 98, and 99. Grooves 97, 98, and 99 are all at an angle of 60 degrees to one another. Module 95 is symmetrical with respect to rotations through any multiple of 60 degrees.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. A wall panel for receiving a detachable accessory, said wall panel comprising:

a. a generally planar front face;

b. a first groove in said front face;

c. a second groove in said front face, said second groove intersecting said first groove at an angle;

said first and second grooves each comprising first and second walls extending generally perpendicular to said front face, said first walls of said first and second grooves being resiliently displaceable away from said second walls of said first and second grooves respectively.

2. The wall panel of claim 1 further comprising a plurality of spaced apart grooves parallel to said first groove.

3. The wall panel of claim, 2 further comprising a plurality of spaced apart grooves parallel to said second groove.

4. The wall panel of claim 3 wherein said first wall comprises a first sheet of resilient material and said wall panel comprises a hollow space on a side of said first sheet away from said groove.

5. The wall panel of claim 4 wherein said second wall comprises a sheet of resilient material and said wall panel comprises a hollow space on a side of said second sheet away from said groove.

6. The wall panel of claim 3 wherein said front face of said panel, said walls of said grooves, and rear walls of said grooves comprise a unitary sheet of material of generally uniform thickness and said grooves comprise indentations in said sheet.

7. The wall panel of claim 6 wherein said grooves comprise rear walls and further comprising a generally planar backer sheet bonded to rear surfaces of said rear walls of said grooves.

8. The wall panel of claim 1 wherein said angle is 90 degrees.

9. The wall panel of claim 1 wherein said angle is 60 degrees.

10. The wall panel of claim 1 wherein said angle is 45 degrees.

11. The wall panel of claim 3 wherein said grooves parallel to said first groove and said grooves parallel to said second groove are spaced apart by the same distance.

12. The wall panel of claim 3 further comprising a plurality of spaced apart grooves in said front face extending at an angle of 45 degrees to said first groove.

13. The wall panel of claim 1 wherein said first and second grooves comprise rear walls and said rear walls comprise notches extending centrally and longitudinally along said rear walls.

14. A system for detachably affixing an accessory to a wall, said system comprising:

a. first planar member having a thickness affixed to said accessory;

b. a second planar member affixed to said accessory at an angle relative to said first planar member;

c. a wall panel module having a front face;

d. means for affixing said wall panel module to said wall;

e. a first groove in said front face for receiving said first planar member, said first groove having first and second walls spaced apart by a distance slightly less than said thickness of said first planar member;

f. a second groove in said front face for receiving said second planar member, said second groove intersecting said first groove at said angle and having first and second walls;

wherein said first wail of said first groove is resiliently displaceable away from said second wall of said first groove by insertion of said first planar member in said first groove.

15. The system of claim 14 wherein said first and second walls of said first groove extend generally perpendicular to said front face.

16. The system of claim 14 further comprising a layer of friction material on a first side of said first planar member.

17. The system of claim 16 wherein said layer of friction material comprises a layer of flexible PVC plastic material permanently bonded to said planar member.

18. The system of claim 16 further comprising a second layer of friction material on a second side of said first planar member.

19. The system of claim 14 wherein said wall panel module has a thickness and said first grooves penetrate substantially entirely through said thickness of said wall panel module.

20. The system of claim 19 wherein said thickness is in the range of 2 centimeters to 6 centimeters.

21. The system of claim 19 wherein said front face, said walls of said grooves and rear walls of said grooves comprise a unitary sheet of resilient material.

22. The system of claim 21 wherein said means for affixing said wall panel module to said wall comprise screws penetrating through said rear walls of said grooves into said wall.

23. The system of claim 14 wherein said angle is 90 degrees.

24. The system of claim 14 wherein said angle is 60 degrees.

25. The system of claim 14 wherein said angle is 45 degrees.

26. A system for detachably affixing an accessory to a wall, said system comprising:

a. a mounting means on said accessory, said mounting means being X-shaped in section and comprising:
   i. a first planar member, having a first width and a first thickness, affixed to said accessory; and
   ii. a second planar member having a width generally equal to said first width and a thickness generally equal to said first thickness affixed to said accessory perpendicular to and intersecting said first planar member, said second planar member projecting generally equally from opposite sides of said first planar member;

b. a wall panel module comprising a unitary sheet of material, said module having a front face;

c. means for affixing said wall panel module to said wall;

d. a first plurality of equally spaced apart indentations in said sheet comprising first grooves in said front face for receiving said first planar member, said first grooves each comprising first and second side walls spaced apart by a distance slightly less than said thickness of said first planar member and a rear wall;

e. a second plurality of equally spaced apart indentations in said sheet comprising second grooves in said front face for receiving said second planar member, said second grooves perpendicularly intersecting said first grooves to provide a matrix of square sections separated by grooves, said second grooves each comprising first and second walls spaced apart by a distance slightly less than said thickness of said second planar member and a rear wall;

front faces of said rear walls of said first and second grooves comprising longitudinal V-shaped notches, said notches comprising generally planar sections of said rear walls intersecting at a dihedral angle;

wherein said first walls of said first and second grooves are resiliently displaceable away from said second walls of said first and second grooves respectively by insertion of said first and second planar members in said first and second grooves respectively to securely hold said first and second planar members in said first and second grooves respectively by frictional forces between faces of said first and second planar members and said walls of said grooves.

* * * * *

UNITED STATES PATENT AND TRADEMARK OFFICE

CERTIFICATE OF CORRECTION

PATENT NO. : 5,477,969

DATED : December 26, 1995

INVENTOR(S) : Colin Beeskau et al.

It is certified that error appears in the above-indentified patent and that said Letters Patent is hereby corrected as shown below:

Column 1, line 17, "dividers rand" should read --dividers and--.

Column 2, line 18, "wail panel" should read --wall panel--.

Column 4, line 21, "at a fight angle" should read --at a right angle--.

Column 4, line 25, "are frilly inserted" should read --are fully inserted--.

Column 8, line 33, "first wail" should read --first wall--.

Signed and Sealed this

Ninth Day of April, 1996

Bruce Lehman

*Attest:*

BRUCE LEHMAN

*Attesting Officer*

*Commissioner of Patents and Trademarks*